US005487467A

United States Patent [19]

Sherman

[11] Patent Number: 5,487,467

[45] Date of Patent: Jan. 30, 1996

[54] DOLL-SHAPED RECEPTACLE FOR PLASTIC BAGS

[76] Inventor: Victoria Sherman, 3116 Alhambra Cir., Coral Gables, Fla. 33134

[21] Appl. No.: 248,665

[22] Filed: May 25, 1994

[51] Int. Cl.[6] ..... B65D 83/00

[52] U.S. Cl. ..... 206/216; 206/457; 206/554; 221/303; 383/24; 383/75; 383/86; 383/97; D9/311

[58] Field of Search ..... D3/234–236, 273, D3/303; D9/310, 311, 316, 339; D21/153, 166, 167; 206/457, 554, 216; 221/45, 63, 303, 311; 383/71, 74, 75, 77, 86, 97, 210, 24

[56] References Cited

U.S. PATENT DOCUMENTS

| | | | |
|---|---|---|---|
| D. 48,947 | 4/1916 | Pfunder | D3/236 |
| D. 53,034 | 3/1919 | Finn | D3/235 |
| D. 60,920 | 4/1922 | Schmucker et al. | D3/236 |
| D. 74,169 | 1/1928 | Cohen | D3/236 |
| D. 143,580 | 1/1946 | Cohen | D3/236 |
| D. 181,304 | 10/1957 | Mann | D3/236 |
| 1,775,796 | 9/1930 | Williams | 383/86 |
| 4,988,216 | 1/1991 | Lyman | 383/86 |
| 5,042,687 | 8/1991 | McKinley | 211/311 |
| 5,285,927 | 2/1994 | Pruitt | 221/303 |
| 5,341,933 | 8/1994 | Willows | 206/554 |

*Primary Examiner*—Jimmy G. Foster
*Attorney, Agent, or Firm*—Malloy & Malloy

[57] ABSTRACT

A receptacle for plastic shopping bags and like articles comprising an upper member having the general structure and appearance of an upper portion of a doll body, and a lower element structured and disposed for receiving articles therein. The lower element, which has the general shape and configuration of a skirt, is attached to the upper member and extends downwardly therefrom. The lower element defines a cavity in which plastic shopping bags can be stored, and also has an opening in communication with the cavity that is sized and configured to allow passage therethrough of a plastic shopping bag. The receptacle may also include means structured and disposed on the lower element for either partially or fully closing the opening and means for suspending the receptacle from a vertical surface. The upper element of the receptacle may additionally include a pair of arms connected together so as to form a holding member for a dish towel.

14 Claims, 1 Drawing Sheet

DOLL-SHAPED RECEPTACLE FOR PLASTIC BAGS

BACKGROUND OF THE INVENTION

1. Field of the Invention

This invention relates generally to a receptacle for plastic shopping bags, and in particular to an attractive, easy to use receptacle for plastic shopping bags in the shape of a doll.

2. Description of the Related Art

Many people accumulate the plastic shopping bags which are a byproduct of grocery shopping for various reasons. These plastic shopping bags, being of a relatively small size, are often found to be suitable for other uses such as lining small trash cans, disposing of cat litter, etc. Also, many supermarkets encourage the recycling of plastic shopping bags, and those persons who return their plastic bags for recycling usually tend to amass a large number before doing so. People generally store these accumulated plastic bags in a haphazard manner, for example, by folding or crumpling them and placing them in a drawer in the kitchen. As a result, there is a need in the art for a suitably convenient means for storing plastic shopping bags for subsequent use or return to the supermarket for recycling. It is also generally recognized that decorative figures such as dolls appeal to many people, primarily women and children. The related art describes receptacles or article holders combined with decorative figures, see, e.g., U.S. Pat. No. 4,782,950, which describes an article holder that includes a hollow container and a decorative figure removably mounted in a support member housed within the container. The present invention is directed toward solving the need for a receptacle for plastic shopping bags by providing an attractive doll-shaped receptacle for plastic shopping bags and similar articles wherein the plastic bags are removably stored within a skirt worn by a doll.

SUMMARY OF THE INVENTION

It is an object of the present invention to provide an easy to use receptacle for conveniently storing plastic shopping bags and like articles.

It is a further object of this invention to provide an attractive receptacle in the general shape of a doll for storing plastic shopping bags and like articles.

Still another object of the present invention is to provide an attractive receptacle for storing plastic shopping bags and like articles which can be conveniently suspended from a vertical surface for use.

Yet another object of the present invention is to provide a receptacle for storing plastic shopping bags and like articles which also includes a holding member for a dish towel.

In accordance with one aspect of the present invention, there is provided a receptacle for plastic shopping bags and like articles comprising an upper member having the general structure and appearance of an upper portion of a doll body, and a lower element structured and disposed for receiving articles therein. The lower element, which has the general shape and configuration of a skirt, is attached to the upper member and extends downwardly therefrom. The lower element defines a cavity in which plastic shopping bags can be stored, and also has an opening in communication with the cavity that is sized and configured to allow passage therethrough of a plastic shopping bag. The receptacle may also include means structured and disposed on the lower element for either partially or fully closing the opening and means for suspending the receptacle from a vertical surface. In addition, the upper element of the receptacle may include a pair of arms connected together so as to form a holding member for a dish towel.

BRIEF DESCRIPTIONS OF THE DRAWINGS

The invention will be better understood after reading the following detailed description of the presently preferred embodiment thereof in which.

DETAILED DESCRIPTION OF THE PREFERRED EMBODIMENT

Figure 1:
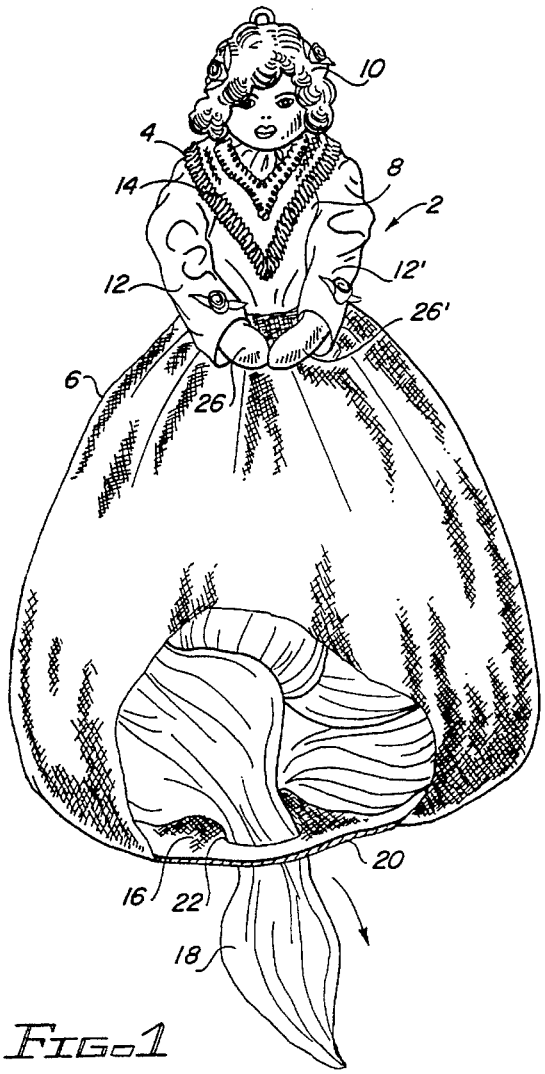
FIG. 1 illustrates a partial cross-sectional front view of the receptacle of the present invention.

Referring to the drawings, there is shown in FIG. 1 the receptacle of the present invention, generally designated as 2, which is structured and configured for removably receiving plastic shopping bags and similar lightweight articles. Receptacle 2 includes an upper member 4 and a lower element 6. Upper member 4 is shaped and configured as the upper portion of a doll body extending generally from the waist upwards, and preferably includes a torso 8, a head 10, and a pair of arms 12, 12'. In the preferred embodiment, upper member 4 includes an outer shell constructed of cloth which defines torso 8 and arms 12, 12' of the doll body, and an inner support element disposed within torso 8 and arms 12, 12' formed of cotton batting, foam rubber or any other suitable resilient material. Head 10 may be constructed of wood, plastic, or even cloth stuffed with support material, and is attached to torso 8 by gluing or any other conventional means of attachment. Head 10 is preferably attractively decorated with the face of a woman wearing makeup, and may include a hairpiece thereon. In the preferred embodiment, upper member 4 is provided with an outer garment 14, constructed preferably of fabric material, which may be a separate blouse or the upper section of a long dress. Outer garment 14 may be securely connected to upper member 4, preferably at the juncture of torso 8 and head 10.

Figure 2:
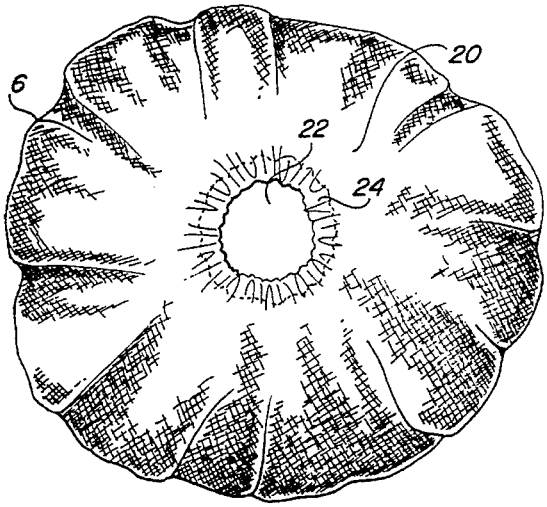
FIG. 2 illustrates a bottom view of the receptacle.
Figure 4:
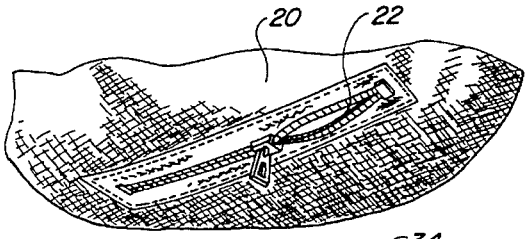
FIG. 4 illustrates one alternative embodiment of a closure means for completely closing the receptacle.
Figure 5:
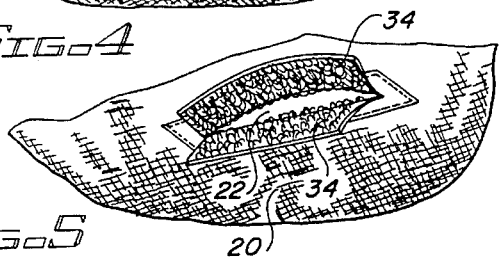
FIG. 5 illustrates another alternative embodiment of a closure means for completely closing the receptacle.

Lower element 6 has the general shape and configuration of a long skirt which extends downwardly from upper member 4. Lower element 6 may be constructed of any suitable material for containing plastic bags and like lightweight articles therein, and in the preferred embodiment is constructed of fabric material and integrally formed with outer garment 14 of upper member 4 as the skirt portion of a long dress. It will be appreciated, however, that lower element 6 may be a separate skirt that is securely attached to outer garment 14 or upper member 4 by any conventional means of attachment such as sewing. Lower element 6 defines a cavity 16 in which a plastic bag 18 may be removably received, and in the preferred embodiment has a bottom zone 20 defining an opening 22 which is sized and configured to allow passage therethrough of plastic bag 18. In one embodiment not shown, opening 22 may be sized just large enough to allow passage therethrough of plastic bag 18 while at the same time being sized small enough so as to contain plastic bag 18 within cavity 16 after being received therein. In the preferred embodiment of the invention, closure means are provided for releasably closing opening 22, either partially or fully, so as to securely captivate plastic bag 18 within cavity 16. In one preferred embodiment illustrated in FIG. 2, an expandable elastic band 24 is sewn within bottom zone 20 in surrounding relation to opening 22 so as to effect a partial closure of opening 22. In this partially closed condition, opening 22 is sized so as to prevent plastic bag 18 from falling out of cavity 16, and requires the user to stretch elastic band 24 and enlarge opening 22 in order to insert plastic bag 18 into, or remove plastic bag 18 from, cavity 16 through opening 22. In other preferred embodiments shown in FIGS. 4 and 5, respectively, hook and loop fastening material 34 or a zipper 36 may be provided for completely yet releasably closing opening 22. It will be appreciated by those skilled in the art, however, that any suitable means for effecting a partial or complete closure of opening 22 can be utilized, such as snap fasteners or a drawstring.

Figure 3:
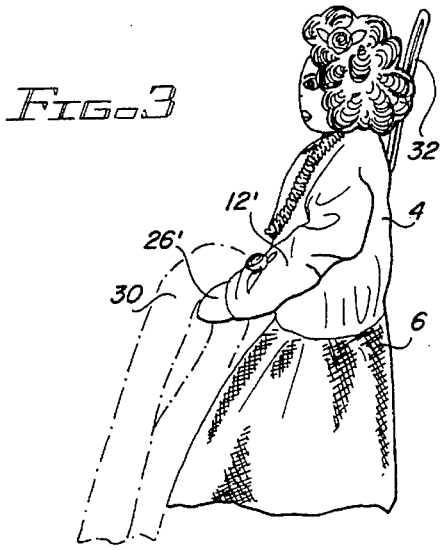
FIG. 3 illustrates a side view of the receptacle showing a towel being retained by the holding member.
Figure 6:
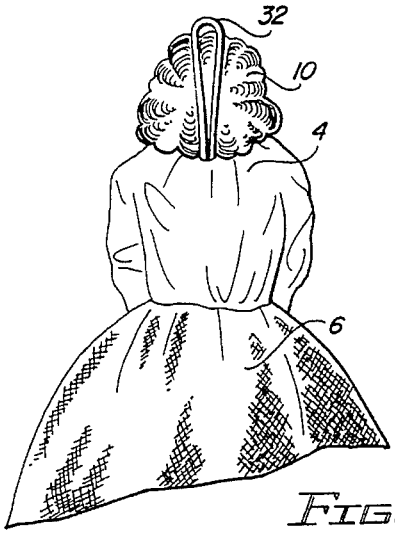
FIG. 6 illustrates a partial rear view of the receptacle showing the suspension means.

In the preferred embodiment shown in FIGS. 1 and 3, the distal ends 26, 26' of arms 12, 12' are connected together to form a holding member for a dish towel 30 or like item, although it will be recognized that the invention may omit this feature. As seen in FIGS. 3 and 6, there is also preferably provided a means for suspending receptacle 2 from a vertical surface such as an outer sidewall of a refrigerator. In the preferred embodiment, the suspension means comprises a loop of string 32 connected to an external rear surface of upper member 4, preferably at the base of head 10, so that upon hanging receptacle 2 from a vertical surface upper element 4 will not tilt forwardly. It will be readily understood, however, that any other conventional means for suspending receptacle 2 may be used. For convenient use of receptacle 2, loop 32 may be engaged with the hook end of a magnetic member that is securely attached to the sidewall or door of a refrigerator, so that receptacle 2 will be suspended vertically in an appropriate location for storage of plastic bag 18.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A receptacle for plastic bags and other like articles, comprising:

(a) an upper member having the general shape and appearance of a portion of a doll body, said doll body portion defining a torso, head, and a pair of arms, said upper member comprising an outer shell and an inner support element disposed within said outer shell, said pair of arms being connected together to form a means for holding a towel or like item, said upper member including a garment constructed of fabric material disposed on said outer shell;

(b) a lower element structured and disposed for receiving articles therein, said lower element being shaped and configured as a skirt, said lower element being constructed of fabric material, said lower element being integrally formed with said garment and extending downwardly therefrom, said lower element defining a cavity therein, said lower element including a bottom zone, said bottom zone defining an opening in communication with said cavity and being sized to allow passage therethrough of an article;

(c) an expandable elasticized band attached to said bottom zone in surrounding relation to said opening, said band being in a normally contracted condition whereby said opening is partially closed; and (d) a loop of string attached to a rear surface of said head of said upper member.

2. A receptacle for plastic bags and other like articles, comprising:

(a) an upper member having a general configuration and appearance of an upper portion of a doll body;

(b) a lower element structured and disposed for receiving an article therein, said lower element having the general shape and configuration of a skirt, said lower element being attached to said upper member and extending downwardly therefrom, said lower element defining a cavity therein, said lower element having an opening therein in communication with said cavity, said opening being structured and dimensioned to allow passage therethrough of the article and to contain the article within said cavity; and (c) said upper element further including a pair of arms, said arms being connected together to form a holding member for a towel or like item.

3. A receptacle as recited in claim 2 further comprising means structured and disposed on said lower element for partially closing said opening.

4. A receptacle as recited in claim 3 wherein said partial closure means comprises an elasticized element disposed about said opening in surrounding relation thereto, said elasticized element being in a normally contracted condition wherein said opening is partially closed.

5. A receptacle as recited in claim 4 wherein said lower element includes a bottom zone defining said opening and said elasticized element is an elastic band attached to said bottom zone.

6. A receptacle as recited in claim 2 further comprising means structured and disposed on said lower element for fully closing said opening.

7. A receptacle as recited in claim 6 wherein said full closure means comprises hook and loop fastening material disposed adjacent said opening.

8. A receptacle as recited in 6 claim wherein said full closure means comprises at least one male snap element and at least one corresponding female snap element disposed adjacent said opening.

9. A receptacle as recited in claim 6 wherein said full closure means comprises a zipper disposed adjacent said opening.

10. A receptacle as recited in claim 2 wherein said lower element is constructed of a fabric material.

11. A receptacle as recited in claim 2 further comprising a garment disposed on an outer surface of said upper member, said garment being constructed of fabric material.

12. A receptacle as recited in claim 11 wherein said lower element is constructed of fabric material and said garment and said lower element are integrally formed.

13. A receptacle as recited in claim 2 further comprising means structured and disposed for suspending said receptacle from a surface.

14. A receptacle as recited in claim 13 wherein said suspension means comprises a loop of string connected to a rear exterior surface of said upper element.

* * * * *